US009891007B2

(12) United States Patent
He et al.

(10) Patent No.: US 9,891,007 B2
(45) Date of Patent: Feb. 13, 2018

(54) BENT HEAT EXCHANGER AND METHOD FOR MANUFACTURING THE SAME

(71) Applicant: SANHUA (HANGZHOU) MICRO CHANNEL HEAT EXCHANGER CO., LTD., Hangzhou (CN)

(72) Inventors: Yan He, Hangzhou (CN); Qiang Gao, Hangzhou (CN); Huazhao Liu, Hangzhou (CN)

(73) Assignee: SANHUA (HANGZHOU) MICRO CHANNEL HEAT EXCHANGER CO., LTD., Hangzhou (CN)

( * ) Notice: Subject to any disclaimer, the term of this patent is extended or adjusted under 35 U.S.C. 154(b) by 357 days.

(21) Appl. No.: 14/778,509

(22) PCT Filed: Jan. 15, 2014

(86) PCT No.: PCT/CN2014/070686

§ 371 (c)(1),
(2) Date: Sep. 18, 2015

(87) PCT Pub. No.: WO2014/146505

PCT Pub. Date: Sep. 25, 2014

(65) Prior Publication Data

US 2016/0290736 A1 Oct. 6, 2016

(30) Foreign Application Priority Data

Mar. 21, 2013 (CN) ..... 2013 1 0093380
Mar. 21, 2013 (CN) ..... 2013 2 0132908 U

(51) Int. Cl.
*F28D 1/047* (2006.01)
*F28D 7/06* (2006.01)
(Continued)

(52) U.S. Cl.
CPC ..... *F28F 1/025* (2013.01); *B21D 53/06* (2013.01); *F25B 39/00* (2013.01); *F28D 1/0471* (2013.01);
(Continued)

(58) Field of Classification Search
CPC ..... F28F 1/025; F28F 9/00; F28F 2225/04; F28F 2280/00; F28D 1/0471; F28D 1/0476; F28D 2001/0273; B21D 53/06
(Continued)

(56) References Cited

U.S. PATENT DOCUMENTS 3,416,600 A * 12/1968 Fink ..... F28F 1/025 165/175
5,531,268 A 7/1996 Ryoichi et al.
(Continued)

FOREIGN PATENT DOCUMENTS

CN 1107221 A 8/1995
CN 101890446 A 11/2010
(Continued)

OTHER PUBLICATIONS

International Search Report for International Application No. PCT/CN2014/070686 dated Mar. 20, 2014.
(Continued)

*Primary Examiner* — Leonard R Leo
(74) *Attorney, Agent, or Firm* — Howard & Howard Attorneys PLLC

(57) ABSTRACT

A bent heat exchanger and a method for manufacturing the same are provided. The bent heat exchanger includes: a first header and a second header spaced apart from each other, a plurality of flat tubes and a plurality of fins. A plurality of flat tubes are disposed between the first header and the second header, two ends of each flat tube are connected with the first header and the second header respectively. Each flat tube has
(Continued)

straight segments and a bent segment between the straight segments, the bent segment is twisted by a predetermined angle relative to the straight segment around a longitudinal direction of the flat tube. The bent segments of a plurality of the flat tubes form a bent segment row extending in a thickness direction of the flat tube. A plurality of the flat tubes are divided into a plurality of groups.

19 Claims, 6 Drawing Sheets

(51) Int. Cl.

| | |
|---|---|
| ***F28F 1/02*** | (2006.01) |
| ***F25B 39/00*** | (2006.01) |
| ***F28F 1/12*** | (2006.01) |
| ***B21D 53/06*** | (2006.01) |
| *F28F 9/013* | (2006.01) |
| *F28D 1/02* | (2006.01) |

(52) U.S. Cl.
CPC ..... *F28F 1/126* (2013.01); *F28D 1/0476* (2013.01); *F28D 2001/028* (2013.01); *F28D 2001/0273* (2013.01); *F28F 9/013* (2013.01); *F28F 2215/04* (2013.01); *F28F 2225/04* (2013.01); *F28F 2280/00* (2013.01)

(58) Field of Classification Search
USPC ..... 165/78, 144, 150, 176; 29/890.053
See application file for complete search history.

(56) References Cited

U.S. PATENT DOCUMENTS

| | | | | |
|---|---|---|---|---|
| 6,546,999 | B1 * | 4/2003 | Dienhart | F28D 1/0476 165/150 |
| 7,104,314 | B2 * | 9/2006 | Valensa | F28D 7/0033 165/164 |
| 9,528,770 | B2 * | 12/2016 | Jiang | F28D 1/0476 |
| 2003/0183378 | A1 * | 10/2003 | Memory | F28D 1/0476 165/176 |

FOREIGN PATENT DOCUMENTS

| | | | |
|---|---|---|---|
| CN | 203274364 | U | 11/2013 |
| FR | 581706 | A | 12/1924 |
| JP | 04187990 | A | 7/1992 |

OTHER PUBLICATIONS

Written Opinion of the International Searching Authority for International Application No. PCT/CN2014/070686 dated Mar. 20, 2014.

International Preliminary Report on Patentability issued for International Application No. PCT/CN2014/070686. dated Sep. 22, 2015.

* cited by examiner

BENT HEAT EXCHANGER AND METHOD FOR MANUFACTURING THE SAME

CROSS-REFERENCE TO RELATED APPLICATION

The present application is a national phase entry under 35 USC § 371 of International Patent Application No. PCT/CN2014/070686 filed Jan. 15, 2014, which claims priority to and all the benefits of Chinese Patent Application No. 201310093380.3 filed Mar. 21, 2013, and Chinese Patent Application No. 201320132908.9 filed Mar. 21, 2013, the entire disclosures of which are hereby expressly incorporated herein by reference in their entirety.

BACKGROUND OF THE INVENTION

1. Field of the Invention

The present disclosure relates to a bent heat exchanger and a method for manufacturing the same.

2. Description of the Related Art

A heat exchanger, e.g., a parallel flow heat exchanger, is widely used in a refrigerating system. In some cases of applications, there is a need to bend the heat exchanger. Traditionally, in the bent heat exchanger, no-fin segments of a flat tube are twisted toward a same direction, and then bent. Because the accumulation of the bending deformation is over large, the bending method may affect the final assembly and the appearance of the heat exchanger, which affects the application.

SUMMARY OF THE INVENTION

Embodiments of the present disclosure seek to solve at least one of the problems existing in the related art to at least some extent or provide a useful commercial choice. Accordingly, an object of the present disclosure is to provide a bent heat exchanger with advantages of a neat, aesthetic appearance, a better assembly effect, a wide application and a high reliability.

Another object of the present disclosure is to provide a method for manufacturing the bent heat exchanger.

To achieve the object described above, a bent heat exchanger is provided according to embodiments of a first aspect of the present disclosure. The bent heat exchanger includes: first and second headers spaced apart from each other; a plurality of flat tubes disposed between the first and second headers and divided into a plurality of groups, each flat tube defining two ends connected with the first and second headers respectively, each flat tube having straight segments and a bent segment which is between the straight segments and twisted by a predetermined angle relative to the straight segment around a longitudinal direction of the flat tube, the bent segments of the plurality of the flat tubes forming a bent segment row extended in a thickness direction of the flat tube, twisting directions of the bent segments of the flat tubes in a same group being identical, and the twisting direction of the bent segment of the flat tube in one group being opposite to that of the bent segment of the flat tube in another group adjacent to the one group; and a plurality of fins each disposed between the straight segments of adjacent flat tubes.

With the bent heat exchanger according to embodiments of the present disclosure, since the twisting directions of the bent segments of the flat tubes in the same group are identical and the twisting direction of the bent segment of the flat tube in one group is opposite to that of the bent segment of the flat tube in another group adjacent to the one group, it is possible to avoid an over large accumulation of the bending deformation of the bent segments after the flat tubes are bent. Thus, the appearance of the bent heat exchanger is neater and more aesthetic, and the bent heat exchanger has a better assembly effect (easy to assemble with an application hardware). Moreover, the length of an arrangement of the flat tubes in the length direction of the first header and the second header is greater than 500 mm (i.e., the length of the first header and the second header is greater than 500 mm), and thus the application range of the bent heat exchanger is widened. Therefore, the bent heat exchanger according to embodiments of the present disclosure has advantages of a neat, aesthetic appearance, a better assembly effect, a wide application and a high reliability.

Furthermore, the bent heat exchanger according to embodiments of the present disclosure may also have the additional technical features as follows.

In some embodiments, each of the flat tubes has one bent segment and the bent segments of the plurality of the flat tubes form one bent segment row. In this way, the bent heat exchanger has an advantage of a simple structure.

In some embodiments, each of the flat tubes has a plurality of the bent segments spaced apart from each other in the longitudinal direction of the flat tube, the bent segments of the plurality of the flat tubes form a plurality of bent segment rows. Thus, the flat tubes can be bent into a plurality of shapes, i.e., the bent heat exchanger may have a plurality of shapes, so that the application range of the bent heat exchanger may be widened.

In some embodiments, an interrupted flat tube is disposed between adjacent groups of the flat tubes and defines first and second segments, a first end of the first segment is connected with the first header, a second end of the first segment is closed, a first end of the second segment is connected with the second header, a second end of the second segment is closed and spaced apart from the second end of the first segment by a predetermined distance equal to or greater than a length of the bent segment. By providing the interrupted flat tube between adjacent groups of the flat tubes, it would be avoided that protrusions produced after the bending of the flat tubes of two groups twisted toward each other collide and interfere with each other. Thus, the assembly effect of the bent heat exchanger may be further improved and the appearance of the bent heat exchanger is neater and more aesthetic.

In some embodiments, a distance between two adjacent flat tubes belonging to different groups is greater than that between two adjacent flat tubes belonging to a same group. Thus, it would be avoided that protrusions produced after the bending of the flat tubes of two groups twisted toward each other collide and interfere with each other. Thus, the assembly effect of the bent heat exchanger may be further improved and the appearance of the bent heat exchanger is neater and more aesthetic.

In some embodiments, a separation flat tube is disposed between adjacent groups of the flat tubes and has straight segments and a bent segment located between the straight segments and corresponding to the bent segment of the flat tube, a width of the separation flat tube is smaller than that of the flat tube. Thus, it would be avoided that protrusions produced after the bending of the flat tubes of two groups twisted toward each other collide and interfere with each other. Thus, the assembly effect of the bent heat exchanger may be further improved and the appearance of the bent heat exchanger is neater and more aesthetic.

In some embodiments, a distance between the separation flat tube and the flat tube adjacent to the separation flat tube is greater than that between adjacent flat tubes. Thus, it would be avoided that protrusions produced after the bending of the flat tubes of two groups twisted toward each other collide and interfere with each other. Thus, the assembly effect of the bent heat exchanger may be further improved and the appearance of the bent heat exchanger is neater and more aesthetic.

In some embodiments, a separation flat tube is disposed between adjacent groups of the flat tubes and has straight segments and a bent segment located between the straight segments and corresponding to the bent segment of the flat tube, a length of the bent segment of the separation flat tube is greater than that of the bent segment of the flat tube. Thus, it would be avoided that protrusions produced after the bending of the flat tubes of two groups twisted toward each other collide and interfere with each other. Thus, the assembly effect of the bent heat exchanger may be further improved and the appearance of the bent heat exchanger is neater and more aesthetic.

According to embodiments of a second aspect of the present disclosure, a method for manufacturing the bent heat exchanger according to embodiments of the first aspect of the present disclosure is provided. The method includes steps of: a) twisting a portion of a flat tube by a predetermined angle relative to a remaining portion of the flat tube around a longitudinal direction of the flat tube so as to form a bent segment, forming a bent segment row extended in a thickness direction of the flat tube by the bent segments of a plurality of the flat tubes, dividing the plurality of the flat tubes into a plurality of groups, twisting directions of the bent segments of the flat tubes in a same group being identical, and the twisting direction of the bent segment of the flat tube in one group being opposite to that of the bent segment of the flat tube in another group adjacent to the one group; b) connecting the flat tube between first and the second headers; c) disposing a plurality of fins between the remaining portions of adjacent flat tubes; and d) bending the flat tubes at the bent segments.

With the method for manufacturing the bent heat exchanger according to embodiments of the present disclosure, since a plurality of the flat tubes are divided into a plurality of groups and the twisting directions of the bent segments of the flat tubes in the same group are identical and the twisting direction of the bent segment of the flat tube in one group is opposite to that of the bent segment of the flat tube in another group adjacent to the one group, it is possible to avoid an over large accumulation of the bending deformation of the bent segments after the flat tubes are bent. Thus, the appearance of the bent heat exchanger is neater and more aesthetic, and the bent heat exchanger has a better assembly effect (easy to assemble with an application hardware). Moreover, the length of an arrangement of the flat tubes in the length direction of the first header and the second header is greater than 500 mm (i.e., the length of the first header and the second header is greater than 500 mm), and thus the application range of the bent heat exchanger is widened. Therefore, the bent heat exchanger having advantages of a neat, aesthetic appearance, a better assembly effect, a wide application and a high reliability may be manufactured by the method for manufacturing the bent heat exchanger according to embodiments of the present disclosure.

In some embodiments, the steps a)-d) can be performed in any order and the step a) is performed prior to the step d). Thus, the method for manufacturing the bent heat exchanger can be more suitable for the actual situation of a manufacturing process, so that the manufacture of the bent heat exchanger is more convenient and easier.

In some embodiments, each of the flat tubes has a plurality of the bent segments spaced apart from each other in the longitudinal direction of the flat tube, the bent segments of the plurality of the flat tubes form a plurality of bent segment rows. Thus, the flat tubes can be bent into a plurality of shapes, i.e., the bent heat exchanger may have a plurality of shapes, so that the application range of the bent heat exchanger may be widened.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

These and other aspects and advantages of embodiments of the present disclosure will become apparent and more readily appreciated from the following descriptions made with reference to the drawings, in which.

DETAILED DESCRIPTION OF THE INVENTION

Figure 1:
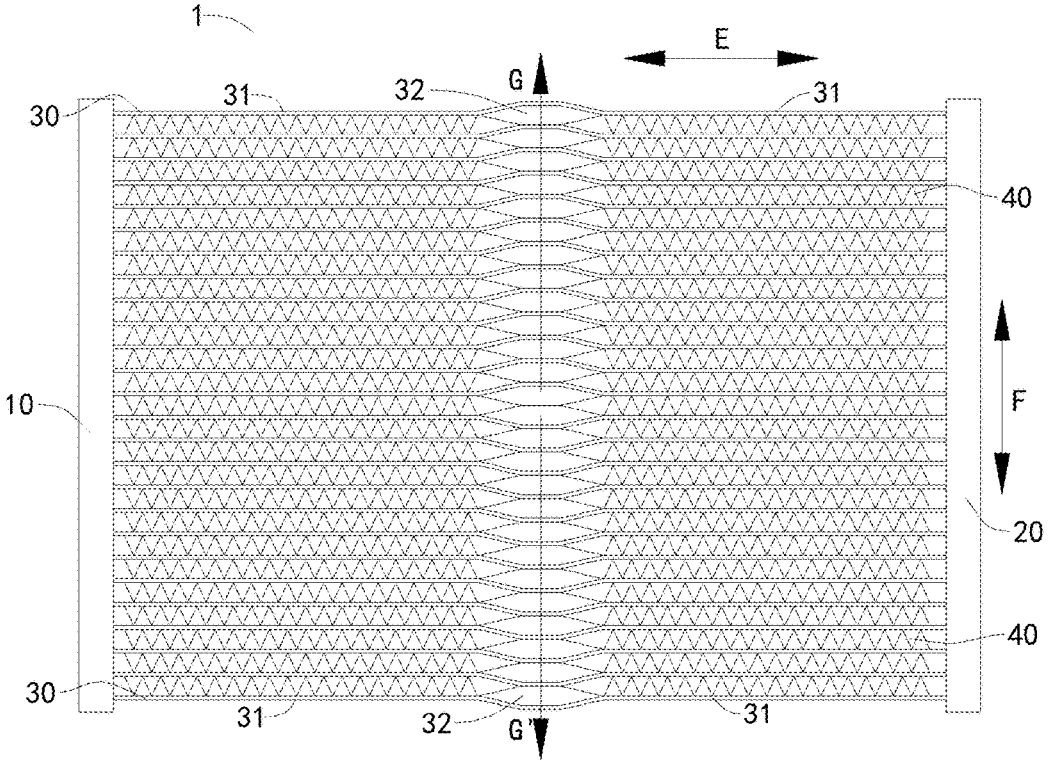
FIG. 1 is a schematic view of a bent heat exchanger before being bent according to an embodiment of the present disclosure.

Reference will be made in detail to embodiments of the present disclosure. The same or similar elements and the elements having same or similar functions are denoted by like reference numerals throughout the descriptions. The embodiments described herein with reference to drawings are explanatory, illustrative, and used to generally understand the present disclosure. The embodiments shall not be construed to limit the present disclosure.

In the specification, unless specified or limited otherwise, relative terms such as "central", "longitudinal", "lateral", "front", "rear", "right", "left", "inner", "outer", "lower", "upper", "horizontal", "vertical", "above", "below", "up", "top", "bottom", "inner", "outer", "clockwise", "anticlockwise" as well as derivative thereof (e.g., "horizontally", "downwardly", "upwardly", etc.) should be construed to refer to the orientation as then described or as shown in the drawings under discussion. These relative terms are for convenience of description and do not require that the present disclosure be constructed or operated in a particular orientation, thus, it should not be construed to limit the present disclosure.

In addition, terms such as "first" and "second" are used herein for purposes of description and are not intended to indicate or imply relative importance or significance. Thus, features limited by "first" and "second" are intended to indicate or imply including one or more than one these features. In the description of the present disclosure, "a plurality of" relates to two or more than two, unless specified or limited otherwise.

In the description of the present disclosure, unless specified or limited otherwise, it should be noted that, terms "mounted," "connected" "coupled" and "fastened" may be understood broadly, such as permanent connection or detachable connection, electronic connection or mechanical connection, direct connection or indirect connection via intermediary, inner communication or inter reaction between two elements. These having ordinary skills in the art should understand the specific meanings in the present disclosure according to specific situations.

In the description of the present disclosure, a structure in which a first feature is "on" a second feature may include an embodiment in which the first feature directly contacts the second feature, and may also include an embodiment in which an additional feature is formed between the first feature and the second feature so that the first feature does not directly contact the second feature, unless otherwise specified. Furthermore, a first feature "on," "above," or "on top of" a second feature may include an embodiment in which the first feature is right "on," "above," or "on top of" the second feature, and may also include an embodiment in which the first feature is not right "on," "above," or "on top of" the second feature, or just means that the first feature has a sea level elevation larger than the sea level elevation of the second feature. While first feature "beneath," "below," or "on bottom of" a second feature may include an embodiment in which the first feature is right "beneath," "below," or "on bottom of" the second feature, and may also include an embodiment in which the first feature is not right "beneath," "below," or "on bottom of" the second feature, or just means that the first feature has a sea level elevation smaller than the sea level elevation of the second feature.

With reference to FIG. 1 to FIG. 5, a bent heat exchanger 1 will be described according to embodiments of the present disclosure. As shown in FIGS. 1-5, the bent heat exchanger 1 includes a first header 10, a second header 20, a plurality of flat tubes 30 and a plurality of fins 40.

The first header 10 and the second header 20 are spaced apart from each other. A plurality of flat tubes 30 are disposed between the first header 10 and the second header 20. Each of the flat tubes 30 defines two ends connected with the first header 10 and the second header 20 respectively and has straight segments 31 and a bent segment 32 located between the straight segments 31. The bent segment 32 is twisted by a predetermined angle relative to the straight segment 31 around a longitudinal direction of the flat tube 30, the longitudinal direction of the flat tube 30 is parallel to a length direction of the flat tube 30 before being bent, the length direction of the flat tube 30 before being bent is shown by an arrow E in FIG. 1 to FIG. 3. The bent segments 32 of a plurality of the flat tubes 30 form a bent segment row extending in a thickness direction of the flat tube 30, the thickness direction of the flat tube 30 is shown by an arrow F in FIG. 1 to FIG. 5. The plurality of the flat tubes are divided into a plurality of groups. Twisting directions of the bent segments 32 of the flat tubes 30 in the same group are identical, and the twisting direction of the bent segment 32 of the flat tube 30 in one group is opposite to that of the bent segment 32 of the flat tube 30 in another group adjacent to the one group. Each fin 40 is disposed between the straight segments 31 of adjacent flat tubes 30, i.e., no fin 40 is disposed between the bent segments 32.

Specifically, if the bent segment 32 of each flat tube 30 of a first group are clockwise twisted by a predetermined angle relative to the straight segment 3 around the longitudinal direction of the flat tube 30, the bent segment 32 of each flat tube 30 of a second group adjacent to the first group are anticlockwise twisted by a predetermined angle relative to the straight segment 31 around the longitudinal direction of the flat tube 30. If the bent segment 32 of each flat tube 30 of a first group are anticlockwise twisted by a predetermined angle relative to the straight segment 3 around the longitudinal direction of the flat tube 30, the bent segment 32 of each flat tube 30 of a second group adjacent to the first group are clockwise twisted by a predetermined angle relative to the straight segment 31 around the longitudinal direction of the flat tube 30.

Figure 6:
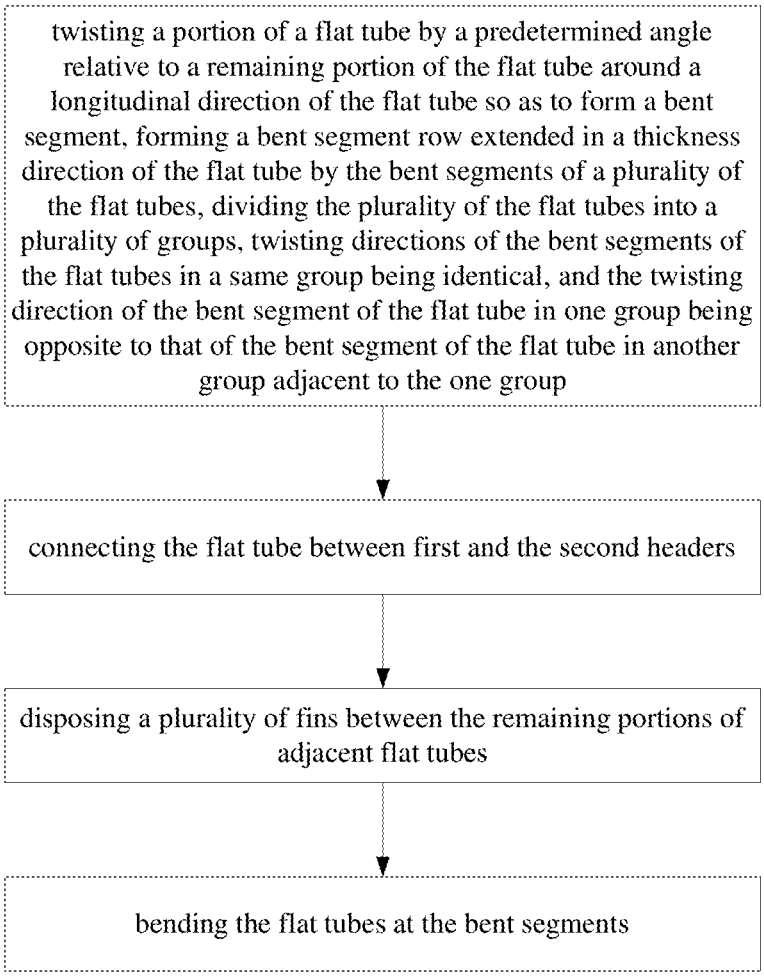
FIG. 6 is a flow chat of a method for manufacturing a bent heat exchanger according to an embodiment of the present disclosure.

With reference to FIG. 6, a method for manufacturing the bent heat exchanger 1 will be described according to embodiments of the present disclosure. As shown in FIG. 6, the method for manufacturing the bent heat exchanger 1 according to embodiments of the present disclosure includes the following steps a)-d).

a) A portion of a flat tube 30 is twisted by a predetermined angle relative to a remaining portion of the flat tube 30 around a longitudinal direction of the flat tube 30 so as to form a bent segment 32, a bent segment row extended in a thickness direction of the flat tube 30 is formed by the bent segments 32 of a plurality of the flat tubes 30, the plurality of the flat tubes 30 are divided into a plurality of groups, in which twisting directions of the bent segments 32 of the flat tubes 30 in a same group are identical, and the twisting direction of the bent segment 32 of the flat tube 30 in one group being opposite to that of the bent segment 32 of the flat tube 30 in another group adjacent to the one group.

In other words, the bent segment 32 of each flat tube 30 refers to a portion of the flat tube 30 twisted around the longitudinal direction of the flat tube 30, and the straight segments 31 of each flat tube 30 refer to the remaining portion of the flat tube 30, i.e., a portion of the flat tube 30 being not twisted.

b) The flat tube 30 is connected between first and the second headers 10, 20.

c) A plurality of fins 40 are disposed between the remaining portions of adjacent flat tubes 30.

d) The flat tubes 30 are bent at the bent segments 32.

With the bent heat exchanger 1 according to embodiments of the present disclosure, since the twisting directions of the bent segments 32 of the flat tubes 30 in the same group are identical and the twisting direction of the bent segment 32 of the flat tube 30 in one group being opposite to that of the bent segment 32 of the flat tube 30 in another group adjacent to the one group, it is possible to avoid an over large accumulation of the bending deformation of the bent segments 32 after the flat tubes 30 are bent. Thus, the appearance of the bent heat exchanger 1 is neater and more aesthetic, and the bent heat exchanger 1 has a better assembly effect (easy to assemble with an application hardware). Moreover, the length of an arrangement of the flat tubes 30 in the length direction of the first header 10 and the second header 20 is greater than 500 mm (i.e., the length of the first header 10 and the second header 20 is greater than 500 mm), and thus the application range of the bent heat exchanger 1 is widened. Therefore, the bent heat exchanger 1 according to embodiments of the present disclosure has advantages of a neat, aesthetic appearance, a better assembly effect, a wide application and a high reliability.

With the method for manufacturing the bent heat exchanger 1 according to embodiments of the present disclosure, since a plurality of the flat tubes 30 are divided into a plurality of groups and the twisting directions of the bent segments 32 of the flat tubes 30 in the same group are identical and the twisting direction of the bent segment 32 of the flat tube 30 in one group being opposite to that of the bent segment 32 of the flat tube 30 in another group adjacent to the one group, it is possible to avoid an over large accumulation of the bending deformation of the bent segments 32 after the flat tubes 30 are bent. Thus, the appearance of the bent heat exchanger 1 is neater and more aesthetic, and the bent heat exchanger 1 has a better assembly effect (easy to assemble with an application hardware). Moreover, the length of an arrangement of the flat tubes 30 in the length direction of the first header 10 and the second header 20 is greater than 500 mm (i.e., the length of the first header 10 and the second header 20 is greater than 500 mm), and thus the application range of the bent heat exchanger 1 is widened. Therefore, the bent heat exchanger 1 having advantages of a neat, aesthetic appearance, a better assembly effect, a wide application and a high reliability may be manufactured by the method for manufacturing the bent heat exchanger 1 according to embodiments of the present disclosure.

FIG. 1 is a schematic view showing a bent heat exchanger 1 before being bent according to an embodiment of the present disclosure. A plurality of the flat tubes 30 are divided into two groups, an arrow G shows the twisting direction of the bent segment 32 of each flat tube 30 of a first group, an arrow G' shows the twisting direction of the bent segment 32 of each flat tube 30 of a second group. Specifically, the bent segment 32 of each flat tube 30 of the first group is twisted in a direction away from the flat tube 30 of the second group and the bent segment 32 of each flat tube 30 of the second group is twisted in a direction away from the flat tube 30 of the first group.

Figure 4:
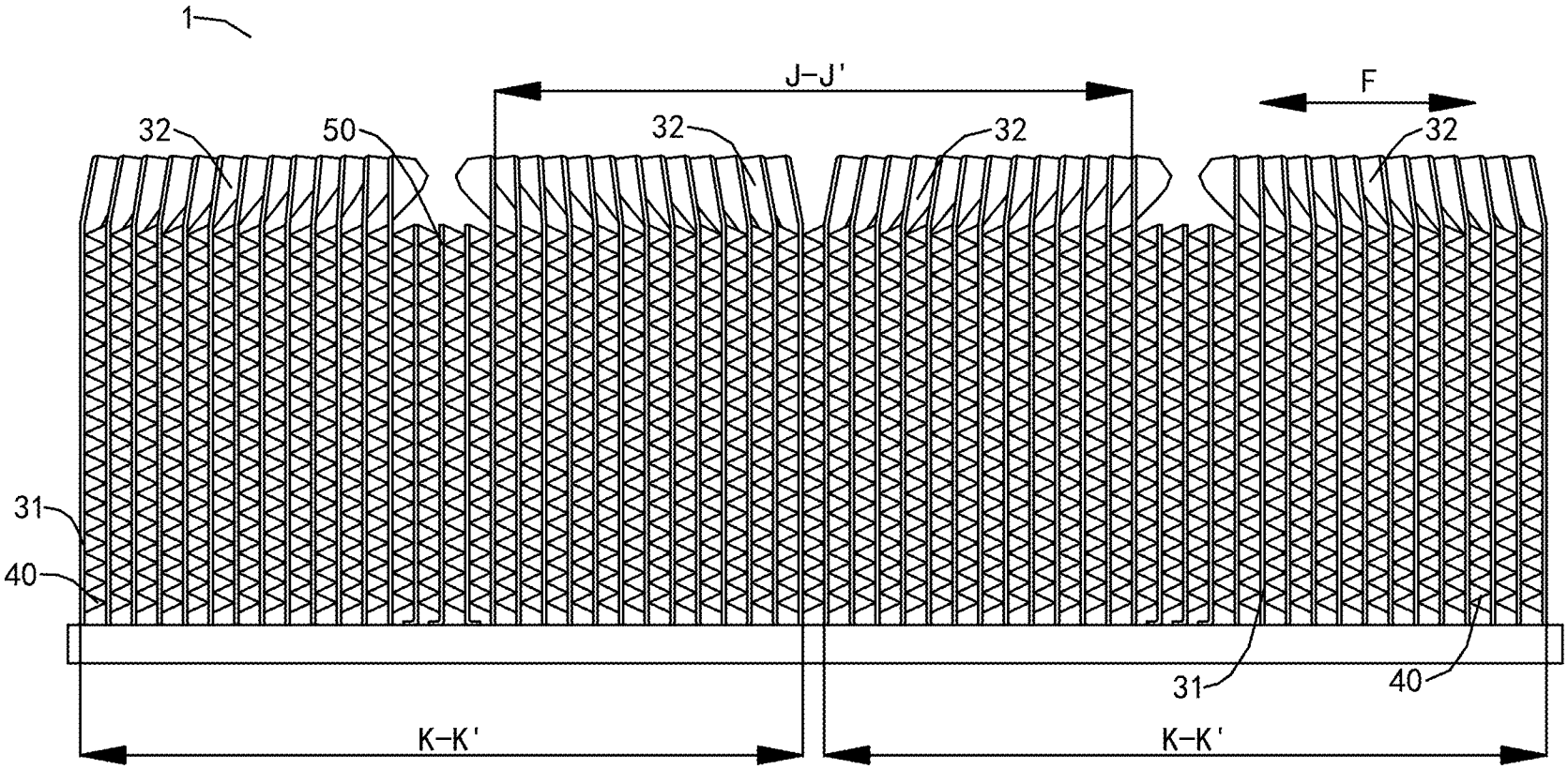
FIG. 4 is a schematic side view of a bent heat exchanger after being bent according to an embodiment of the present disclosure.
Figure 5:
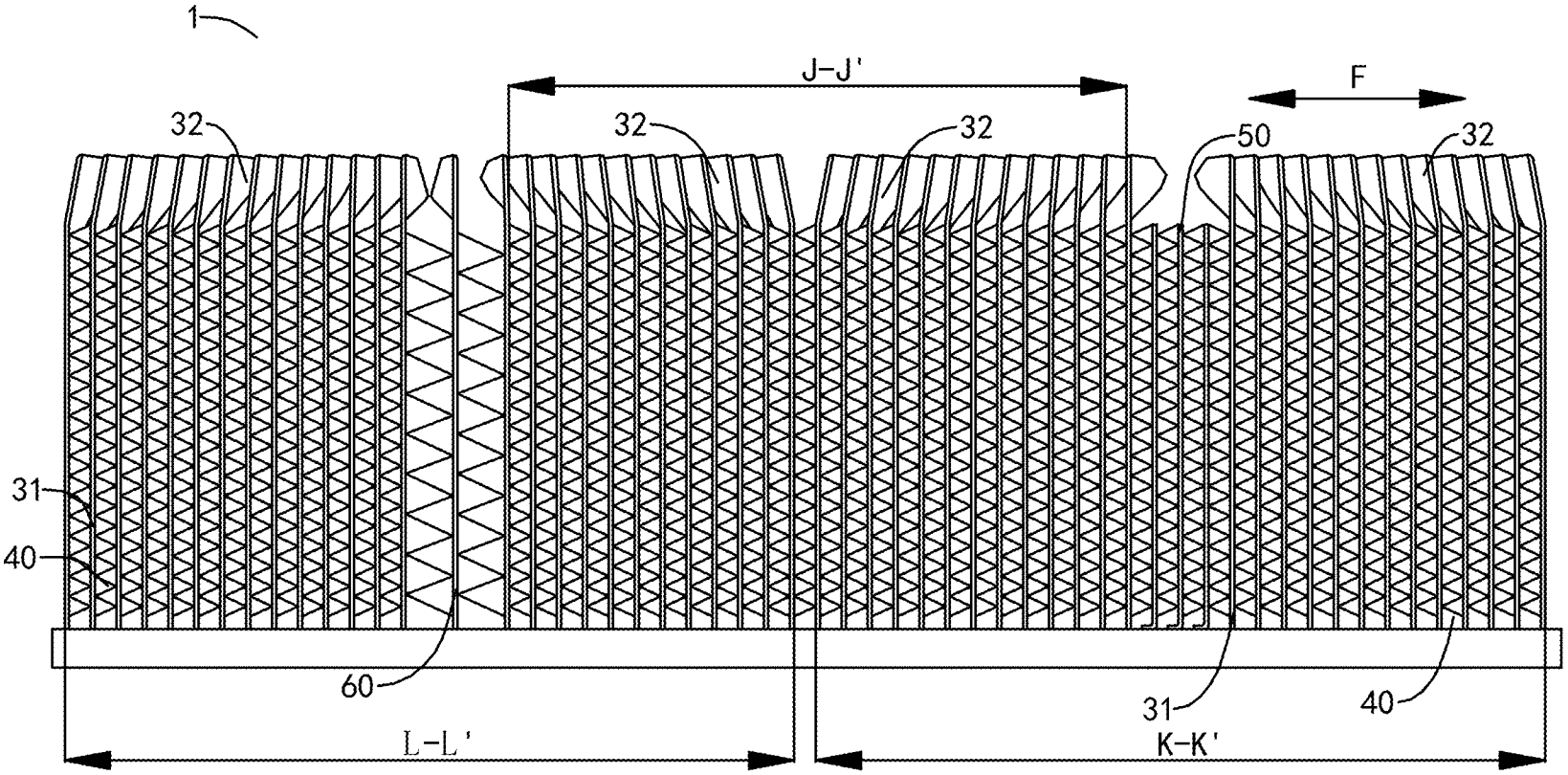
FIG. 5 is a schematic side view of a bent heat exchanger after being bent according to another embodiment of the present disclosure.

Specifically, FIG. 4 and FIG. 5 are schematic views showing a bent heat exchanger 1 after being bent according to some embodiments of the present disclosure. The bent heat exchanger 1 shown in FIG. 1 may have a shape of J-J' segment in FIG. 4 and FIG. 5 after being bent.

In some embodiments of the present disclosure, the steps a)-d) may be performed in any order and the step a) is performed prior to the step d). Thus, the method for manufacturing the bent heat exchanger 1 can be more suitable for the actual situation of a manufacturing process, so that the manufacture of the bent heat exchanger 1 is more convenient and easier.

Figure 2:
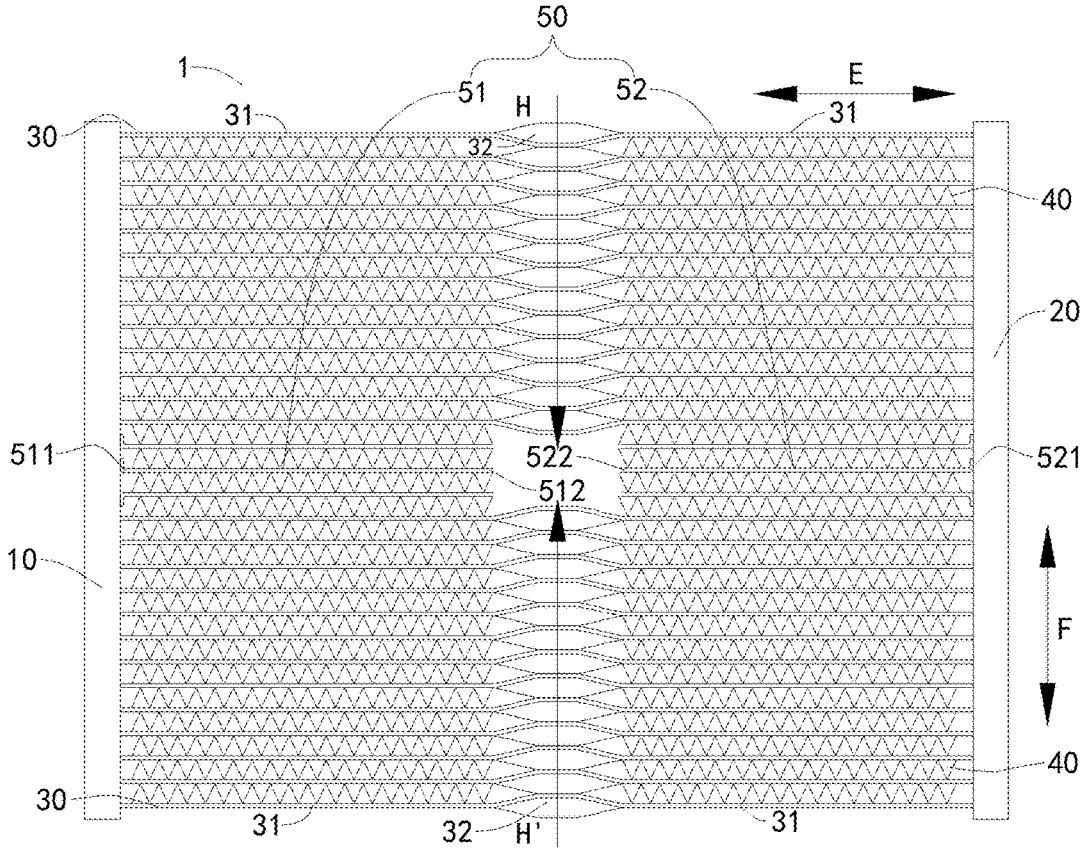
FIG. 2 is a schematic view of a bent heat exchanger before being bent according to another embodiment of the present disclosure.

FIG. 2 is a schematic view showing a bent heat exchanger 1 before being bent according to another embodiment of the present disclosure. An interrupted flat tube 50 may be disposed between adjacent groups of the flat tubes 30 and may define a first segment 51 and a second segment 52, a first end 511 of the first segment 51 may be connected with the first header 10, a second end 512 of the first segment 51 may be closed, a first end 521 of the second segment 52 may be connected with the second header 20, a second end 522 of the second segment 52 may be closed and spaced apart from the second end 512 of the first segment 51 by a predetermined distance, the predetermined distance may be equal to or greater than a length of the bent segment 32.

When the bent segment 32 of each flat tube 30 of the first group of two adjacent groups is twisted toward the direction of the second group of the two adjacent groups and the bent segment 32 of each flat tube 30 of the second group of the two adjacent groups is twisted toward the direction of the first group (i.e., the flat tubes 30 of two groups are twisted toward each other), after the flat tubes 30 are bent at the bent segment 32, the protrusions produced after the bending of the flat tubes 30 of the two groups collide and interfere with each other (that is, meet). By providing the interrupted flat tube 50 between two adjacent groups of the flat tubes 30, it would be avoided that protrusions produced after the bending of the flat tubes 30 of two groups twisted toward each other collide and interfere with each other and the protrusions are. Thus, the assembly effect of the bent heat exchanger 1 may be further improved and the appearance of the bent heat exchanger 1 is neater and more aesthetic.

Specifically, as shown in FIG. 2, a plurality of the flat tubes 30 are divided into two groups, an arrow H shows the twisting direction of the bent segment 32 of each flat tube 30 of a first group, an arrow H' shows the twisting direction of the bent segment 32 of each flat tube 30 of a second group. Because the predetermined distance between the second end 522 of the second segment 52 and the second end 512 of the first segment 51 may be greater than or equal to the length of the bent segment 32, a containing space is formed between two groups of the flat tubes 30, which may be used for containing the protrusions produced after the bending of the flat tubes 30 of the two groups. The bent heat exchanger 1 shown in FIG. 2 may have a shape of K-K' segment in FIG. 4 and FIG. 5 after being bent.

Advantageously, there may be a plurality of the interrupted flat tubes 50, which may be provided between two adjacent groups of the flat tubes 30. Thus, it would be further avoided that protrusions produced after the bending of the flat tubes 30 of two groups twisted toward each other collide and interfere with each other. Thus, the assembly effect of the bent heat exchanger 1 may be further improved and the appearance of the bent heat exchanger 1 is neater and more aesthetic.

In some embodiments of the present disclosure, the distance between the two adjacent flat tubes 30 belonging to different groups may be greater than that between the two adjacent flat tubes 30 belonging to the same group. In other words, the distance between the flat tubes 30 of two adjacent groups may be greater than that between the flat tubes 30 of the same group. Thus, it would be avoided that protrusions produced after the bending of the flat tubes 30 of two groups twisted toward each other collide and interfere with each other. Thus, the assembly effect of the bent heat exchanger 1 may be further improved and the appearance of the bent heat exchanger 1 is neater and more aesthetic.

Figure 3:
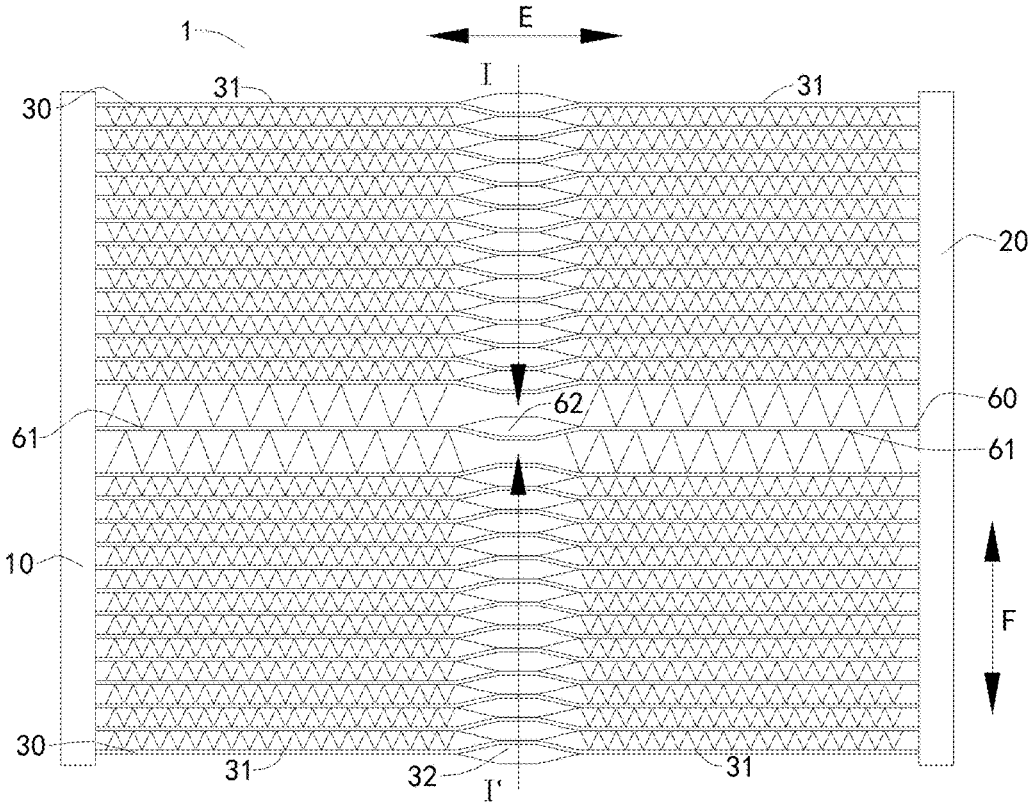
FIG. 3 is a schematic view of a bent heat exchanger before being bent according to a further embodiment of the present disclosure.

FIG. 3 is a schematic view showing a bent heat exchanger 1 before being bent according to a further embodiment of the present disclosure. A separation flat tube 60 may be disposed between adjacent groups of the flat tubes 30 and may have straight segments 61 and a bent segment 62 located between the straight segments 61, the bent segment 62 of the separation flat tube 60 may correspond to the bent segment 32 of the flat tube 30, a width of the separation flat tube 60 is smaller than that of the flat tube 30. In other words, the bent segment 62 of the separation flat tube 60 may correspond to the bent segment 32 of the flat tube 30 in the thickness direction of the flat tube 30. Advantageously, a projection of the bent segment 62 of the separation flat tube 60 in the thickness direction of the flat tube 30 may coincide with a projection of the bent segment 32 of the flat tube 30 in the thickness direction of the flat tube 30.

Because the width of the separation flat tube 60 is smaller than that of the flat tube 30, the distance between the separation flat tube 60 and the flat tube 30 may be increased. Thus, it would be avoided that protrusions produced after the bending of the flat tubes 30 of two groups twisted toward each other collide and interfere with each other. Thus, the assembly effect of the bent heat exchanger 1 may be further improved and the appearance of the bent heat exchanger 1 is neater and more aesthetic.

Advantageously, as shown in FIG. 3, the separation flat tube 60 may be disposed between adjacent groups of the flat tubes 30 and may have straight segments 61 and a bent segment 62 located between the straight segments 61, the bent segment 62 of the separation flat tube 60 may correspond to the bent segment 32 of the flat tube 30, the distance between the separation flat tube 60 and the flat tube 30 adjacent to the separation flat tube 60 may be greater than that between adjacent flat tubes 30. Thus, it would be avoided that protrusions produced after the bending of the flat tubes 30 of two groups twisted toward each other collide and interfere with each other. Thus, the assembly effect of the bent heat exchanger 1 may be further improved and the appearance of the bent heat exchanger 1 is neater and more aesthetic.

Specifically, as shown in FIG. 3, a plurality of the flat tubes 30 are divided into two groups, an arrow I shows the twisting direction of the bent segment 32 of each flat tube 30 of a first group, an arrow I' shows the twisting direction of the bent segment 32 of each flat tube 30 of a second group. Because the distance between the separation flat tube 60 and the flat tube 30 adjacent to the separation flat tube 60 may be greater than that between adjacent flat tubes 30, a containing space is formed between the separation flat tube 60 and the flat tube 30 adjacent to the separation flat tube 60, which may be used for containing the protrusions produced after the bending of the flat tubes 30 of the two groups. The bent heat exchanger 1 shown in FIG. 3 may have a shape of L-L' segment in FIG. 5 after being bent.

In another specific embodiment of the present disclosure, a separation flat tube 60 may be disposed between adjacent groups of the flat tubes 30 and may have straight segments 61 and a bent segment 62 located between the straight segments 61, the bent segment 62 of the separation flat tube 60 may correspond to the bent segment 32 of the flat tube 30, the length of the bent segment 62 of the separation flat tube 60 may be greater than that of the bent segment 32 of the flat tube 30. Thus, it would be avoided that protrusions produced after the bending of the flat tubes 30 of two groups twisted toward each other collide and interfere with each other. Thus, the assembly effect of the bent heat exchanger 1 may be further improved and the appearance of the bent heat exchanger 1 is neater and more aesthetic.

As shown in FIG. 1 to FIG. 3, in one embodiment of the present disclosure, each flat tube 30 may have one bent segment 32, and the bent segments 32 of a plurality of the flat tubes 30 may form one bent segment row. In this way, the bent heat exchanger 1 has an advantage of simple structure.

In another embodiment of the present disclosure, each of the flat tubes 30 has a plurality of bent segments 32 spaced apart from each other in the length direction of the flat tube 30 and the bent segments 32 of a plurality of the flat tubes 30 may form a plurality of bent segment rows. Thus, the flat tubes 30 can be bent into a plurality of shapes, i.e., the bent heat exchanger 1 may have a plurality of shapes, so that the application range of the bent heat exchanger 1 may be widened.

The bent heat exchanger 1 according to embodiments of the present disclosure has advantages of a neat, aesthetic appearance and a better assembly effect.

Reference throughout this specification to "an embodiment," "some embodiments," "an example," "a specific example," or "some examples," means that a particular feature, structure, material, or characteristic described in connection with the embodiment or example is included in at least one embodiment or example of the present disclosure. Thus, the appearances of the phrases such as "in some embodiments," "in one embodiment", "in an embodiment", "in another example," "in an example," "in a specific example," or "in some examples," in various places throughout this specification are not necessarily referring to the same embodiment or example of the present disclosure. Furthermore, the particular features, structures, materials, or characteristics may be combined in any suitable manner in one or more embodiments or examples.

The invention has been described in an illustrative manner. It is to be understood that the terminology which has been used is intended to be in the nature of words of description rather than of limitation. Many modifications and variations of the invention are possible in light of the above teachings. Therefore, within the scope of the appended claims, the invention may be practiced other than as specifically described.

What is claimed is:

1. A bent heat exchanger, comprising:

first and second headers spaced apart from each other;

a plurality of flat tubes disposed between the first and second headers and divided into a plurality of groups, each flat tube defining two ends connected with the first and second headers respectively, each flat tube having straight segments and a bent segment which is between the straight segments and twisted by a predetermined angle relative to the straight segment around a longitudinal direction of the flat tube, the bent segments of the plurality of the flat tubes forming a bent segment row extended in a thickness direction of the flat tube, twisting directions of the bent segments of the flat tubes in a same group being identical, and the twisting direction of the bent segment of the flat tube in one group being opposite to that of the bent segment of the flat tube in another group adjacent to the one group; and a plurality of fins each disposed between the straight segments of adjacent flat tubes.

2. The bent heat exchanger according to claim 1, wherein each of the flat tubes has one bent segment and the bent segments of the plurality of the flat tubes form one bent segment row.

3. The bent heat exchanger according to claim 2, wherein an interrupted flat tube is disposed between adjacent groups of the flat tubes and defines first and second segments, a first end of the first segment is connected with the first header, a second end of the first segment is closed, a first end of the second segment is connected with the second header, a second end of the second segment is closed and spaced apart from the second end of the first segment by a predetermined distance equal to or greater than a length of the bent segment.

4. The bent heat exchanger according to claim 2, wherein a distance between two adjacent flat tubes belonging to different groups is greater than that between two adjacent flat tubes belonging to a same group.

5. The bent heat exchanger according to claim 2, wherein a separation flat tube is disposed between adjacent groups of the flat tubes and has straight segments and a bent segment located between the straight segments and corresponding to the bent segment of the flat tube, a width of the separation flat tube is smaller than that of the flat tube.

6. The bent heat exchanger according to claim 2, wherein a separation flat tube is disposed between adjacent groups of the flat tubes and has straight segments and a bent segment located between the straight segments and corresponding to the bent segment of the flat tube, a length of the bent segment of the separation flat tube is greater than that of the bent segment of the flat tube.

7. The bent heat exchanger according to claim 1, wherein each of the flat tubes has a plurality of the bent segments spaced apart from each other in the longitudinal direction of the flat tube, the bent segments of the plurality of the flat tubes form a plurality of bent segment rows.

8. The bent heat exchanger according to claim 7, wherein an interrupted flat tube is disposed between adjacent groups of the flat tubes and defines first and second segments, a first end of the first segment is connected with the first header, a second end of the first segment is closed, a first end of the second segment is connected with the second header, a second end of the second segment is closed and spaced apart from the second end of the first segment by a predetermined distance equal to or greater than a length of the bent segment.

9. The bent heat exchanger according to claim 7, wherein a distance between two adjacent flat tubes belonging to different groups is greater than that between two adjacent flat tubes belonging to a same group.

10. The bent heat exchanger according to claim 7, wherein a separation flat tube is disposed between adjacent groups of the flat tubes and has straight segments and a bent segment located between the straight segments and corresponding to the bent segment of the flat tube, a width of the separation flat tube is smaller than that of the flat tube.

11. The bent heat exchanger according to claim 7, wherein a separation flat tube is disposed between adjacent groups of the flat tubes and has straight segments and a bent segment located between the straight segments and corresponding to the bent segment of the flat tube, a length of the bent segment of the separation flat tube is greater than that of the bent segment of the flat tube.

12. The bent heat exchanger according to claim 1, wherein an interrupted flat tube is disposed between adjacent groups of the flat tubes and defines first and second segments, a first end of the first segment is connected with the first header, a second end of the first segment is closed, a first end of the second segment is connected with the second header, a second end of the second segment is closed and spaced apart from the second end of the first segment by a predetermined distance equal to or greater than a length of the bent segment.

13. The bent heat exchanger according to claim 1, wherein a distance between two adjacent flat tubes belonging to different groups is greater than that between two adjacent flat tubes belonging to a same group.

14. The bent heat exchanger according to claim 1, wherein a separation flat tube is disposed between adjacent groups of the flat tubes and has straight segments and a bent segment located between the straight segments and corresponding to the bent segment of the flat tube, a width of the separation flat tube is smaller than that of the flat tube.

15. The bent heat exchanger according to claim 14, wherein a distance between the separation flat tube and the flat tube adjacent to the separation flat tube is greater than that between adjacent flat tubes.

16. The bent heat exchanger according to claim 1, wherein a separation flat tube is disposed between adjacent groups of the flat tubes and has straight segments and a bent segment located between the straight segments and corresponding to the bent segment of the flat tube, a length of the bent segment of the separation flat tube is greater than that of the bent segment of the flat tube.

17. A method for manufacturing a bent heat exchanger, comprising the steps of:

a) twisting a portion of a flat tube by a predetermined angle relative to a remaining portion of the flat tube around a longitudinal direction of the flat tube so as to form a bent segment, forming a bent segment row extended in a thickness direction of the flat tube by the bent segments of a plurality of the flat tubes, dividing the plurality of the flat tubes into a plurality of groups, twisting directions of the bent segments of the flat tubes in a same group being identical, and the twisting direction of the bent segment of the flat tube in one group being opposite to that of the bent segment of the flat tube in another group adjacent to the one group;

b) connecting the flat tube between first and the second headers;

c) disposing a plurality of fins between the remaining portions of adjacent flat tubes; and d) bending the flat tubes at the bent segments.

18. The method according to claim 17, wherein the steps a)-d) can be performed in any order and the step a) is performed prior to the step d).

19. The method according to claim 17, wherein each of the flat tubes has a plurality of the bent segments spaced apart from each other in the longitudinal direction of the flat tube, the bent segments of the plurality of the flat tubes form a plurality of bent segment rows.

* * * * *